US008061447B2

(12) United States Patent
Krueger, V

(10) Patent No.: US 8,061,447 B2
(45) **Date of Patent: *Nov. 22, 2011**

(54) VARIABLE LINKAGE ASSISTED GRIPPER

(75) Inventor: Rudolph Ernst Krueger, V, Aliso Viejo, CA (US)

(73) Assignee: WWT International, Inc., Anaheim, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/819,126

(22) Filed: Jun. 18, 2010

(65) Prior Publication Data

US 2010/0314131 A1 Dec. 16, 2010

Related U.S. Application Data

(63) Continuation of application No. 11/939,375, filed on Nov. 13, 2007, now Pat. No. 7,748,476.

(60) Provisional application No. 60/859,014, filed on Nov. 14, 2006.

(51) Int. Cl.
*E21B 4/18* (2006.01)
*E21B 23/04* (2006.01)

(52) U.S. Cl. ..... 175/99; 175/98; 166/212; 166/217

(58) Field of Classification Search ..... 175/98, 175/99; 166/212, 217

See application file for complete search history.

(56) References Cited

U.S. PATENT DOCUMENTS

| | | | |
|---|---|---|---|
| 2,141,030 | A | 12/1938 | Clark |
| 2,167,194 | A | 7/1939 | Anderson |
| 2,271,005 | A | 1/1942 | Grebe |
| 2,569,457 | A | 10/1951 | Dale et al. |
| 2,727,722 | A | 12/1955 | Conboy |
| 2,946,565 | A | 7/1960 | Williams |
| 2,946,578 | A | 7/1960 | De Smaele |
| 3,138,214 | A | 6/1964 | Bridwell |
| 3,180,436 | A | 4/1965 | Kellner et al. |
| 3,180,437 | A | 4/1965 | Kellner et al. |
| 3,185,225 | A | 5/1965 | Ginies |
| 3,224,513 | A | 12/1965 | Weeden, Jr. |

(Continued)

FOREIGN PATENT DOCUMENTS

DE 2439063 2/1976

(Continued)

OTHER PUBLICATIONS

UK Search Report dated May 25, 2007 for Application GB0704656.8.

(Continued)

*Primary Examiner* — Giovanna Wright

(74) *Attorney, Agent, or Firm* — Knobbe, Martens, Olson & Bear, LLP

(57) ABSTRACT

A gripper mechanism for downhole tool is disclosed that includes a linkage mechanism and a flexible toe disposed over the linkage mechanism. In operation, an axial force generated by a power section of the gripper expands the linkage mechanism, which applies a radial expansion force to the flexible toe. For certain expansion diameters, the expansion force can be primarily transmitted to the toe from a roller-ramp interface expanding the linkage. For other expansion diameters, the expansion force can be primarily transmitted to the toe by expansion of the linkage in a three-bar linkage configuration. For other expansion diameters, the expansion force can be primarily transmitted to the toe by expansion of the linkage in a four-bar linkage configuration. Thus, the gripper can provide a desired expansion force over a large range of expansion diameters.

23 Claims, 18 Drawing Sheets

U.S. PATENT DOCUMENTS 3,224,734 A 12/1965 Hill
3,225,843 A 12/1965 Ortloff et al.
3,376,942 A 4/1968 Van Winkle
3,497,019 A 2/1970 Ortloff
3,599,712 A 8/1971 Magill
3,606,924 A 9/1971 Malone
3,661,205 A 5/1972 Belorgey
3,664,416 A 5/1972 Nicolas et al.
3,797,589 A 3/1974 Kellner et al.
3,827,512 A 8/1974 Edmond
RE28,449 E 6/1975 Edmond
3,941,190 A 3/1976 Conover
3,978,930 A 9/1976 Schroeder
3,992,565 A 11/1976 Gatfield
4,040,494 A 8/1977 Kellner
4,085,808 A 4/1978 Kling
4,095,655 A 6/1978 Still
4,141,414 A 2/1979 Johansson
4,314,615 A 2/1982 Sodder, Jr. et al.
4,365,676 A 12/1982 Boyadjieff et al.
4,372,161 A 2/1983 de Buda et al.
4,385,021 A 5/1983 Neeley
4,440,239 A 4/1984 Evans
4,463,814 A 8/1984 Horstmeyer et al.
4,558,751 A 12/1985 Huffaker
4,573,537 A 3/1986 Hirasuna et al.
4,615,401 A 10/1986 Garrett
4,674,914 A 6/1987 Wayman et al.
4,686,653 A 8/1987 Staron et al.
4,811,785 A 3/1989 Weber
4,821,817 A 4/1989 Cendre et al.
4,854,397 A 8/1989 Warren et al.
4,951,760 A 8/1990 Cendre et al.
5,010,965 A 4/1991 Schmelzer
5,052,211 A 10/1991 Cohrs et al.
5,090,259 A 2/1992 Shishido et al.
5,169,264 A 12/1992 Kimura
5,184,676 A 2/1993 Graham et al.
5,186,264 A 2/1993 du Chaffaut
5,203,646 A 4/1993 Landsberger et al.
5,310,012 A 5/1994 Cendre et al.
5,363,929 A 11/1994 Williams et al.
5,394,951 A 3/1995 Pringle et al.
5,419,405 A 5/1995 Patton
5,425,429 A 6/1995 Thompson
5,449,047 A 9/1995 Schivley, Jr.
5,467,832 A 11/1995 Orban et al.
5,519,668 A 5/1996 Montaron
5,542,253 A 8/1996 Ganzel
5,613,568 A 3/1997 Sterner et al.
5,622,231 A 4/1997 Thompson
5,752,572 A 5/1998 Baiden et al.
5,758,731 A 6/1998 Zollinger
5,758,732 A 6/1998 Liw
5,765,640 A 6/1998 Milne et al.
5,794,703 A 8/1998 Newman et al.
5,803,193 A 9/1998 Krueger et al.
5,845,796 A 12/1998 Miller
5,857,731 A 1/1999 Heim et al.
5,947,213 A 9/1999 Angle et al.
5,954,131 A 9/1999 Salwasser
5,960,895 A 10/1999 Chevallier et al.
5,996,979 A 12/1999 Hrusch
6,003,606 A 12/1999 Moore et al.
6,026,911 A 2/2000 Angle et al.
6,031,371 A 2/2000 Smart
6,089,323 A 7/2000 Newman et al.
6,112,809 A 9/2000 Angle
6,230,813 B1 5/2001 Moore et al.
6,241,031 B1 6/2001 Beaufort et al.
6,273,189 B1 8/2001 Gissler et al.
6,286,592 B1 9/2001 Moore et al.
6,315,043 B1 11/2001 Farrant et al.
6,345,669 B1 2/2002 Buyers et al.
6,347,674 B1 2/2002 Bloom et al.
6,378,627 B1 4/2002 Tubel et al.
6,427,786 B2 8/2002 Beaufort et al.
6,431,291 B1 8/2002 Moore et al.
6,464,003 B2 10/2002 Bloom et al.
6,478,097 B2 11/2002 Bloom et al.
6,601,652 B1 8/2003 Moore et al.
6,640,894 B2 11/2003 Bloom et al.
6,651,747 B2 11/2003 Chen et al.
6,679,341 B2 1/2004 Bloom et al.
6,715,559 B2 4/2004 Bloom et al.
6,745,854 B2 6/2004 Bloom et al.
6,758,279 B2 7/2004 Moore et al.
6,827,149 B2 12/2004 Hache
6,868,906 B1 3/2005 Vail, III et al.
6,910,533 B2 6/2005 Guerrero
6,920,936 B2 * 7/2005 Sheiretov et al. ..... 166/382
6,938,708 B2 9/2005 Bloom et al.
6,953,086 B2 10/2005 Simpson
7,048,047 B2 5/2006 Bloom et al.
7,059,417 B2 6/2006 Moore et al.
7,080,700 B2 7/2006 Bloom et al.
7,080,701 B2 7/2006 Bloom et al.
7,121,364 B2 10/2006 Mock et al.
7,156,181 B2 1/2007 Moore et al.
7,174,974 B2 2/2007 Bloom et al.
7,185,716 B2 3/2007 Bloom et al.
7,188,681 B2 3/2007 Bloom et al.
7,191,829 B2 3/2007 Bloom et al.
7,222,682 B2 5/2007 Doering et al.
7,273,109 B2 9/2007 Moore et al.
7,275,593 B2 10/2007 Bloom et al.
7,303,010 B2 12/2007 de Guzman et al.
7,343,982 B2 3/2008 Mock et al.
7,353,886 B2 4/2008 Bloom et al.
7,392,859 B2 7/2008 Mock et al.
7,401,665 B2 7/2008 Guerrero et al.
7,493,967 B2 2/2009 Mock et al.
7,516,782 B2 4/2009 Sheiretov et al.
7,516,792 B2 4/2009 Lonnes et al.
7,604,060 B2 10/2009 Bloom et al.
7,607,495 B2 10/2009 Bloom et al.
7,607,497 B2 10/2009 Mock et al.
7,624,808 B2 12/2009 Mock
7,743,849 B2 6/2010 Kotsonis et al.
7,748,476 B2 * 7/2010 Krueger, V ..... 175/99
7,836,950 B2 11/2010 Vail, III et al.
7,854,258 B2 12/2010 Sheiretov et al.
7,900,699 B2 3/2011 Ramos et al.
2001/0045300 A1 11/2001 Fincher et al.
2002/0032126 A1 3/2002 Kusmer
2002/0079107 A1 6/2002 Simpson
2002/0088648 A1 7/2002 Krueger et al.
2003/0024710 A1 2/2003 Post et al.
2003/0150609 A1 8/2003 Stoesz
2003/0183383 A1 10/2003 Guerrero
2005/0034874 A1 2/2005 Guerrero et al.
2005/0145415 A1 7/2005 Doering et al.
2005/0217861 A1 10/2005 Misselbrook
2006/0180318 A1 8/2006 Doering et al.
2007/0056745 A1 3/2007 Contant
2007/0095532 A1 5/2007 Head et al.
2007/0181298 A1 8/2007 Sheiretov et al.
2007/0256827 A1 11/2007 Guerrero et al.
2007/0261887 A1 11/2007 Pai et al.
2008/0061647 A1 3/2008 Schmitt
2008/0066963 A1 3/2008 Sheiretov et al.
2008/0073077 A1 3/2008 Tunc et al.
2008/0110635 A1 5/2008 Loretz et al.
2008/0149339 A1 6/2008 Krueger V
2008/0169107 A1 7/2008 Redlinger et al.
2008/0196901 A1 8/2008 Aguirre et al.
2008/0202769 A1 8/2008 Dupree et al.
2008/0223573 A1 9/2008 Nelson et al.
2008/0314639 A1 12/2008 Kotsonis et al.
2009/0008150 A1 1/2009 Lavrut et al.
2009/0025941 A1 1/2009 Iskander et al.
2009/0071659 A1 3/2009 Spencer et al.
2009/0071660 A1 3/2009 Martinez et al.
2009/0091278 A1 4/2009 Montois et al.
2009/0159295 A1 6/2009 Guerrero et al.
2009/0218105 A1 9/2009 Hill et al.
2009/0229820 A1 9/2009 Saeed

| | | | |
|---|---|---|---|
| 2009/0236101 | A1 | 9/2009 | Nelson et al. |
| 2009/0294124 | A1 | 12/2009 | Patel |
| 2009/0301734 | A1 | 12/2009 | Tunc et al. |
| 2009/0321141 | A1 | 12/2009 | Kotsonis et al. |
| 2010/0018695 | A1 | 1/2010 | Bloom et al. |
| 2010/0018720 | A1 | 1/2010 | Mock |
| 2010/0038138 | A1 | 2/2010 | Mock et al. |
| 2010/0108387 | A1 | 5/2010 | Bloom et al. |
| 2010/0163251 | A1 | 7/2010 | Mock et al. |
| 2010/0263856 | A1 | 10/2010 | Lynde et al. |
| 2010/0307832 | A1 | 12/2010 | Mock et al. |

FOREIGN PATENT DOCUMENTS

| | | | |
|---|---|---|---|
| DE | 2920049 | | 2/1987 |
| EP | 0 149 528 | A1 | 7/1985 |
| EP | 0 951 611 | B1 | 1/1993 |
| EP | 0 257 744 | B1 | 1/1995 |
| EP | 0 767 289 | A1 | 4/1997 |
| EP | 0911483 | | 4/1997 |
| EP | 1 281 834 | A | 2/2003 |
| EP | 1 344 893 | A2 | 9/2003 |
| EP | 1370891 | | 11/2006 |
| EP | 1223305 | | 4/2008 |
| GB | 894117 | | 4/1962 |
| GB | 1105701 | | 3/1968 |
| GB | 2 241 723 | A | 9/1991 |
| GB | 2 305 407 | | 4/1997 |
| GB | 2 310 871 | A | 9/1997 |
| GB | 2 346 908 | A | 8/2000 |
| GB | 2401130 | | 11/2004 |
| WO | WO 89/05391 | | 6/1989 |
| WO | WO 92/13226 | | 8/1992 |
| WO | WO 93/18277 | | 9/1993 |
| WO | WO 94/27022 | | 11/1994 |
| WO | WO 95/21987 | | 8/1995 |
| WO | WO 00/36266 | | 6/2000 |
| WO | WO 00/46461 | | 8/2000 |
| WO | WO 00/63606 | | 10/2000 |
| WO | WO 00/73619 | | 12/2000 |
| WO | WO 02/44509 | A2 | 6/2002 |
| WO | WO 2005/057076 | | 6/2005 |
| WO | WO 2007039025 | | 4/2007 |
| WO | WO 2007134748 | | 11/2007 |
| WO | WO 2008/104177 | | 9/2008 |
| WO | WO 2008/104178 | | 9/2008 |
| WO | WO 2008/104179 | | 9/2008 |
| WO | WO 2008/128542 | | 10/2008 |
| WO | WO 2008/128543 | | 10/2008 |
| WO | WO 2009/062718 | | 5/2009 |
| WO | WO 2010/062186 | | 6/2010 |
| WO | WO 2011/005519 | | 1/2011 |

OTHER PUBLICATIONS

PCT International Search Report and Written Opinion of the ISA dated Jun. 16, 2005 for International Application No. PCT/US2005/008919.

PCT International Search Report and Written Opinion of the ISA dated Apr. 22, 2008 for International Application No. PCT/US2007/084574.

"Kilobomac to Challenge Tradition" Norwegian Oil Review, 1988, pp. 50-52.

U.S. Appl. No. 60/201,353, and cover sheet, filed May 2, 2000 entitled "Borehole Retention Device" in 22 pages.

* cited by examiner

VARIABLE LINKAGE ASSISTED GRIPPER

CROSS-REFERENCE TO RELATED APPLICATIONS

This application is a continuation of U.S. patent application Ser. No. 11/939,375, entitled "VARIABLE LINKAGE ASSISTED GRIPPER," filed on Nov. 13, 2007, which claims the benefit of U.S. Provisional Patent Application No. 60/859,014, entitled "VARIABLE LINKAGE ASSISTED GRIPPER," filed on Nov. 14, 2006, both of which are hereby incorporated by reference herein in their entireties.

BACKGROUND OF THE INVENTION

1. Field of the Invention

The present application relates generally to gripping mechanisms for downhole tools.

2. Description of the Related Art

Tractors for moving within underground boreholes are used for a variety of purposes, such as oil drilling, mining, laying communication lines, borehole intervention and many other purposes. In the petroleum industry, for example, a typical oil well comprises a vertical borehole that is drilled by a rotary drill bit attached to the end of a drill string. The drill string may be constructed of a series of connected links of drill pipe that extend between ground surface equipment and the aft end of the tractor. Alternatively, the drill string may comprise flexible tubing or "coiled tubing" connected to the aft end of the tractor. A drilling fluid, such as drilling mud, is pumped from the ground surface equipment through an interior flow channel of the drill string and through the tractor to the drill bit. The drilling fluid is used to cool and lubricate the bit, and to remove debris and rock chips from the borehole, which are created by the drilling process. The drilling fluid returns to the surface, carrying the cuttings and debris, through the annular space between the outer surface of the drill pipe and the inner surface of the borehole.

Tractors for moving within downhole passages are often required to operate in harsh environments and limited space. For example, tractors used for oil drilling may encounter hydrostatic pressures as high as 16,000 psi and temperatures as high as 300° F. Typical boreholes for oil drilling are 3.5-27.5 inches in diameter. Further, to permit turning, the tractor length should be limited. Also, tractors must often have the capability to generate and exert substantial force against a formation. For example, operations such as drilling require thrust forces as high as 30,000 pounds.

Western Well Tool, Incorporated has developed a variety of downhole tractors for drilling, completion and intervention processes for wells and boreholes. These various tractors are intended to provide locomotion, to pull or push various types of loads. For each of these various types of tractors, various types of gripper elements have been developed. Thus an important part of the downhole tractor tool is its gripper system.

In one known design, a tractor comprises an elongated body, a propulsion system for applying thrust to the body, and grippers for anchoring the tractor to the inner surface of a borehole or passage while such thrust is applied to the body. Each gripper has an actuated position in which the gripper substantially prevents relative movement between the gripper and the inner surface of the passage, and a retracted position in which the gripper permits substantially free relative movement between the gripper and the inner surface of the passage.

Typically, each gripper is slidingly engaged with the tractor body so that the body can be thrust longitudinally while the gripper is actuated.

Tractors may have at least two grippers that alternately actuate and reset to assist the motion of the tractor. In one cycle of operation, the body is thrust longitudinally along a first stroke length while a first gripper is actuated and a second gripper is retracted. During the first stroke length, the second gripper moves along the tractor body in a reset motion. Then, the second gripper is actuated and the first gripper is subsequently retracted. The body is thrust longitudinally along a second stroke length. During the second stroke length, the first gripper moves along the tractor body in a reset motion. The first gripper is then actuated and the second gripper subsequently retracted. The cycle then repeats. Alternatively, a tractor may be equipped with only a single gripper for specialized applications of well intervention, such as movement of sliding sleeves or perforation equipment. In still another alternative, a tractor can be equipped with more than two, such as three grippers along the tractor body.

Grippers may be designed to be powered by fluid, such as drilling mud in an open tractor system or hydraulic fluid in a closed tractor system. Typically, a gripper assembly has an actuation fluid chamber that receives pressurized fluid to cause the gripper to move to its actuated position. The gripper assembly may also have a retraction fluid chamber that receives pressurized fluid to cause the gripper to move to its retracted position. Alternatively, the gripper assembly may have a mechanical retraction element, such as a coil spring or leaf spring, which biases the gripper back to its retracted position when the pressurized fluid is discharged. Motor-operated or hydraulically controlled valves in the tractor body can control the delivery of fluid to the various chambers of the gripper assembly.

SUMMARY OF THE INVENTION

In certain embodiments, a gripper assembly is provided comprising an elongate body, an expansion surface, and a linkage. The elongate body has a length along a first axis. The linkage is configured to be radially expanded between a retracted position and an expanded position relative to the elongate body. The linkage comprises a first link having a first end and a second end, and a second link coupled to the second end of the first link. The first end of the first link is slidably mounted to the elongate body. At least one of the first end of the first link and the second end of the second link forms a base angle relative to the first axis. For a first expansion range from a first position to a second position, movement of the first end of the first link relative to the second end of the second link radially expands the linkage. For a second expansion range a rate of change in the base angle is limited while the linkage radially expands. Desirably, the rate of change in the base angle is reduced through outward radial movement of the second end of the second link In other embodiments a gripper assembly is provided comprising a gripper. The gripper comprises a first portion and a second portion. The gripper has a first end and a second end. The gripper is expandable between a retracted position and an expanded position. Movement of the first end of the gripper towards the second end of the gripper expands the gripper for a first expansion range. Radial movement of the second end of the gripper expands the gripper for a second expansion range.

In other embodiments, a gripper assembly is provided comprising an elongate body, a power section, an expansion surface, and a linkage. The elongate body has a length along a first axis. The power section is configured to exert a force along the first axis. The power section has a stroke length. The expansion surface is slideable with respect to and, desirably, is slidably mounted on the elongate body. The linkage is configured to be radially expanded between a retracted position and an expanded position relative to the elongate body. The linkage comprises a first link having a first end and a second end, and a second link coupled to the second end of the first link. The first end of the first link is slidably mounted to the elongate body and movable responsive to application of the force by the power section. For a first expansion range from a first position to a second position, movement of the first end of the first link relative to the second link of the linkage radially expands the linkage. For a second expansion range, the expansion surface bears on the linkage to radially expand the linkage. The linkage has a diametric expansion defined by a difference between a diameter of the gripper assembly with the linkage in the expanded position and the diameter of the gripper assembly with the linkage in the retracted position. A ratio of the stroke length to the diametric expansion of the linkage is approximately 3.1/5.

In other embodiments, a gripper assembly is provided comprising an elongate body and a linkage. The elongate body has a length. The linkage is configured to be radially expanded. The linkage acts as a three-bar linkage over a first radial expansion range and as a four-bar linkage over a second radial expansion range.

In other embodiments, a gripper assembly is provided comprising an elongate body, an expansion surface, and a linkage. The elongate body has a length along a first axis. The expansion surface is slidably mounted on the elongate body. The linkage is configured to be radially expanded between a retracted position and an expanded position relative to the elongate body. The linkage has a first end and a second end, the first end of the linkage is slidably mounted to the elongate body and movable responsive to application of a longitudinal force. For a first expansion range from a first position to a second position, movement of the first end of the linkage relative to the second end of the linkage radially expands the linkage. For a second expansion range, the expansion surface bears on the linkage to radially expand the linkage.

In other embodiments, a gripper assembly comprises an elongate body and a linkage. The elongate body has a length along a first axis. The linkage comprises a first link and a second link pivotably interconnected in series and expandable relative to the elongate body from a retracted position to an expanded position. The first link has a first end coupled to the elongate body and a second end pivotally coupled to the second link. The second link has a first end pivotally coupled to the first link and a second end that is radially extendable from the elongate body. For a first expansion range of the linkage, rotation of the first and second link relative to one another radially expands the linkage. For a second expansion range of the linkage mechanism, outward radial movement of the second end of the second link radially expands the linkage.

In other embodiments, a method for imparting a force to a passage is provided. The method comprises positioning a force applicator in the passage, generating a radial expansion force over a first expansion range, generating a radial expansion force over a second expansion range. The force applicator comprises an expandable assembly comprising an elongate body and a first link having a first end coupled to the elongate body and a second end opposite the first end, and a second link having a first end coupled to the second end of the first link and a second end coupled to the elongate body. Generating a radial expansion force over a first expansion range is performed by buckling the first and second links with respect to the elongate body. Generating a radial expansion force over a second expansion range is performed by moving the second end of the second link radially outward with respect to the elongate body.

DETAILED DESCRIPTION OF THE PREFERRED EMBODIMENT

Overview VLG—Variable-Linkage Assisted Gripper

Figure 1:
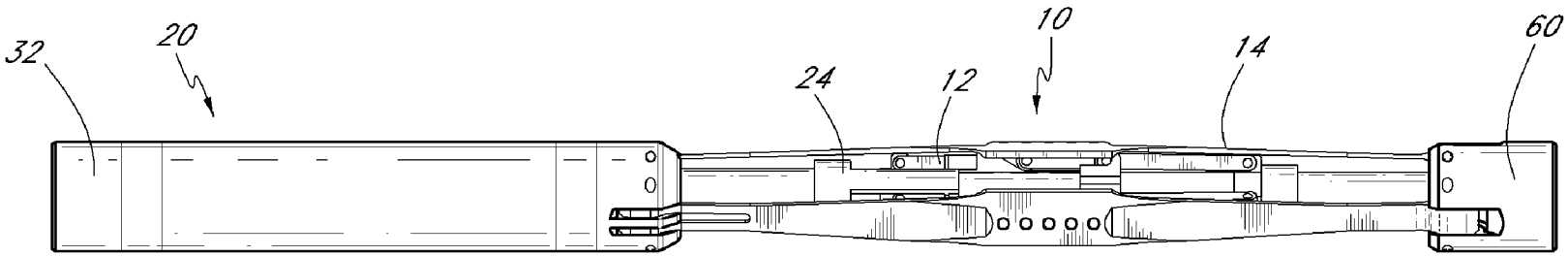
FIG. 1 is a side view of one embodiment of gripper assembly.

With respect to FIG. 1, in certain embodiments, an expandable gripper assembly 10 can comprise a linkage or link mechanism 12 and a flexible continuous beam 14. In some embodiments, the linkage 12 comprises three links configured to form either a three or four-bar linkage dependent upon an expansion diameter of the gripper assembly. As further described below, the linkage 12 can accomplish large maximum to collapsed diameter ratios for the gripper assembly. One benefit of this new Variable-Linkage Assisted Gripper (VLG) is that acceptable expansion forces are maintained over a wider diametrical range than current generation grippers. Accordingly, the VLG gripper can desirably be used in wellbores having relatively small entry locations, but relatively larger internal diameters.

Figure 2:
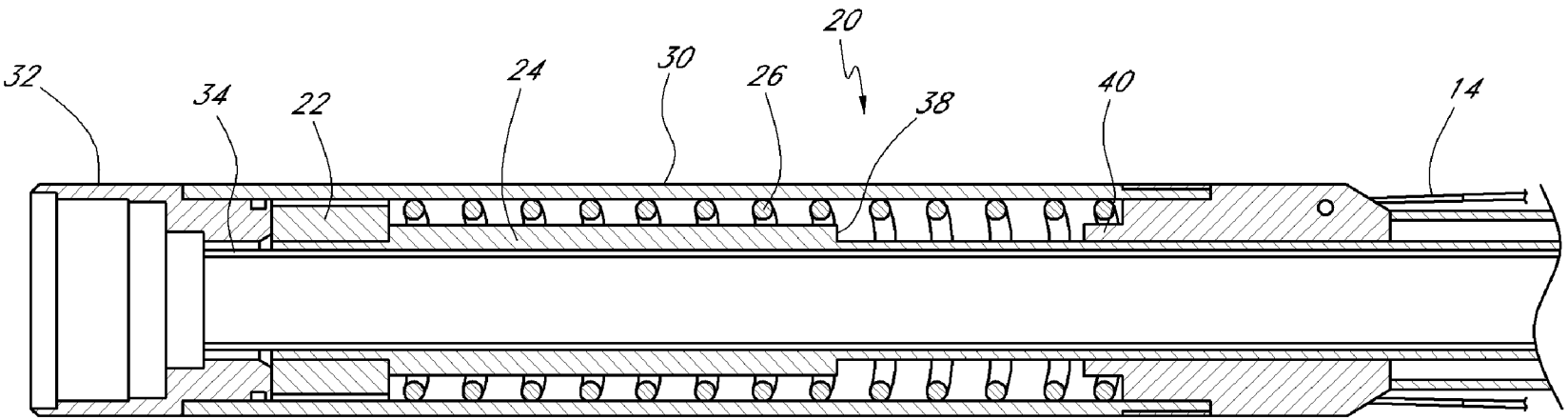
FIG. 2 is a cross-sectional side view of an actuator of the gripper assembly of FIG. 1.

With reference to FIGS. 1 and 2, as further described below, in certain embodiments, the gripper assembly can include a power section or actuator 20 to actuate the gripper between a collapsed state and an expanded state. In some embodiments, the power section can comprise a hydraulically-actuated piston 22-in-cylinder 30 actuator 20. A piston force generated within the cylinder 30 of the VLG may advantageously start the gripper expansion process. As discussed in greater detail below, this force, can desirably be conveyed through a piston rod 24 to thrust an-expansion surface such as defined by a ramp 90 axially underneath a link connection between adjacent links of the linkage (from left to right in the following figures). This expansion surface can exert an expansion force on the link connection, which in turn exerts an expansion force on an inner surface of the continuous beam 14 to a formation or casing that the beam is in contact with. As discussed in greater detail below, at greater expansion diameters, the links of the linkage 12 can depart the expansion surface.

In certain embodiments, the linkage 12 and actuator 20 can also be configured to limit the expansion force of the expandable gripper assembly 10 at relatively large expansion radii to prevent overstressing the components of the linkage. In a three bar linkage, a radial expansion force exerted by the linkage (and thus, the reaction force supported by the links and connectors) is proportional to the sine of an angle formed between a link of the linkage and the tool body. Thus, as a three-bar linkage is expanded and the expansion angle approaches 90 degrees, the reaction forces within the link can become extreme, thus limiting further radial expansion of a three-bar linkage. Thus, as described further below, in some embodiments of gripper assembly 10, the linkage 12 can be configured to provide additional radial expansion once a maximum angular expansion has been reached without overstressing the links and link connectors.

A. VLG Gripper Assembly

The VLG gripper assembly can be a stand alone subassembly that can be configured to be adaptable to substantially all applicable tractor designs. In some embodiments, a spring return, single acting hydraulic cylinder actuator 20 can provide an axial force to the linkage 12 to translate into radial force. This radial force may deflect flexible continuous beams 14 outward until either a wellbore or casing is engaged or the radial deflection ceases due to mechanical stops within the actuator 20. As with certain previous grippers, the VLG may allow axial translation of a tractor shaft while the gripper assembly 10 engages the hole or casing wall.

With reference to FIG. 1, in some embodiments, the VLG gripper assembly can comprise two subassemblies: a power section or actuator 20, and an expandable gripper assembly 10. For ease of discussion, these two subassemblies are discussed separately below. However, it is contemplated that in other embodiments of VLG gripper, more subassemblies can be present or the actuator 20 and expandable gripper assembly 10 can be integrated such that it is difficult to consider each as separate subassemblies. As used herein, "actuator" and "expandable gripper assembly" are broad terms and include integrated designs. Furthermore, in some embodiments an expandable gripper assembly 10 can be provided apart from an actuator 20 such that the expandable gripper assembly 10 of the VLG gripper described herein can be fit to existing actuators of existing tractors, for example single or double acting hydraulic piston actuators, electric motors, or other actuators.

With respect to FIG. 2, a cross-sectional view of an embodiment of actuator 20 of the VLG is illustrated. In the illustrated embodiment, the actuator comprises a single acting, spring return hydraulically powered cylinder. Thus, in the illustrated embodiment, a piston 22 can be longitudinally displaced within a cylinder 30 by a pressurized fluid acting on the piston 22. Pressurized fluid media is delivered between a gripper connector 32 and the piston 22. The fluid media acts upon an outer diameter of the mandrel 34 and an internal diameter of the gripper cylinder 30, creating a piston force. The piston force acts upon the piston 22 with enough force to axially deform a return spring 26. The piston 22 is connected to a piston rod 24. The piston 22 can continue axial displacement with respect to the mandrel 34 with an increase in pressure of the supplied fluid until an interference surface 38 defining a stroke limiting feature of the piston rod 24 makes contact with a continuous beam support 40. In the illustrated embodiments, a continuous beam 14, partially seen, is rotatably coupled to the beam support at 40 such as by a pinned connection. In the illustrated embodiment, the gripper connector 32 and beam support 40 are connected to each other via the gripper cylinder 30.

In other embodiments, the actuator 20 can comprise other types of actuators such as dual acting piston/cylinder assemblies or an electric motor. The actuator 20 can create a force (either from pressure in hydraulic fluid or electrically-induced rotation) and convey it to the expandable gripper assembly 10. In the illustrated embodiment, the expandable gripper assembly 10 comprises a linkage 12 and a flexible continuous beam 14. In other embodiments, the expandable gripper assembly 10 can be configured differently such that the gripper assembly 10 can have a different expansion profile.

FIG. 1 illustrates an embodiment of the VLG gripper in a collapsed configuration. When the illustrated embodiment of VLG gripper is incorporated in a tractor, an elongate body or mandrel of the tractor is attached to the gripper connector 32 and a mandrel cap 60. The mandrel can fix the distance between the gripper connector 32 and the mandrel cap 60 during the expansion process and can provide a passage for the pressurized fluid media to the actuator 20 when the piston is positioned within the cylinder (FIG. 2) at any location along the mandrel. In the illustrated embodiment, the piston rod 24 connects the actuator 20 to the expandable gripper assembly 10 of the VLG gripper.

In the illustrated embodiment, when the VLG gripper is expanded, the expandable gripper assembly 10 converts the axial piston force of the actuator 20 to radial expansion force. The linkage 12 expands, transmitting the radial expansion force through the continuous beam 14. The continuous beam 14 can apply the radial expansion force onto a formation or casing of a bore hole.

Figure 3:
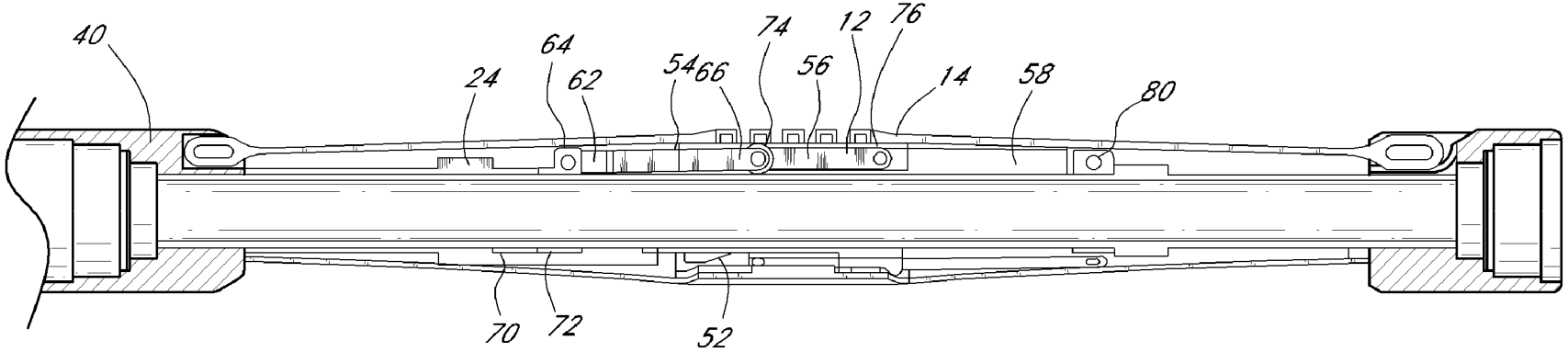
FIG. 3 is a cross-sectional side view of a linkage of the gripper assembly of FIG. 1.

FIG. 3 shows a cross-sectional view of the VLG expandable gripper assembly 10 in a retracted or collapsed state. As illustrated, the piston rod 24 is coupled to the operating sleeve 52 such that axial movement of the piston rod 24 moves the operating sleeve 52 axially. See also, for example, FIGS. 5-7 for the connection of the piston rod 24 to the operating sleeve 52.

With continued reference to FIG. 3, in the illustrated embodiment, the linkage 12 comprises three links: a first, or push link 54, a second or toe link 56, and a third or support link 58. The links 54, 56, 58 are rotatably connected to one another in series, such as by pinned connections. In the illustrated embodiments, a first end 62 of the push link 54 is rotatably coupled to an elongate body defining the expandable gripper assembly 10 at a push link support 64, such as by a pinned connection. The push link support 64 can be axially slideable with respect to the elongate body along a distance of the body. In the illustrated embodiments, the push link support 64 can be axially slideable between a first point 70 and a second point 72. A second end 66 of the push link 54 can be rotatably connected to the toe link 56 such as with a pin. The toe link 56 can be rotatably connected to the support link 58.

With continued reference to FIG. 3, at the rotatable connection of the push link 54 to the toe link 56, there can be an interface mechanism such as a roller 74 configured to maintain contact with either the operating sleeve 52 and the continuous beam 14, or just the continuous beam 14, depending on expansion diameter. In other embodiments, the interface mechanism can be spaced apart from the rotatable connection. This interface mechanism reacts the radial expansion force generated through the mechanism and into the continuous beam 14.

Figure 4:
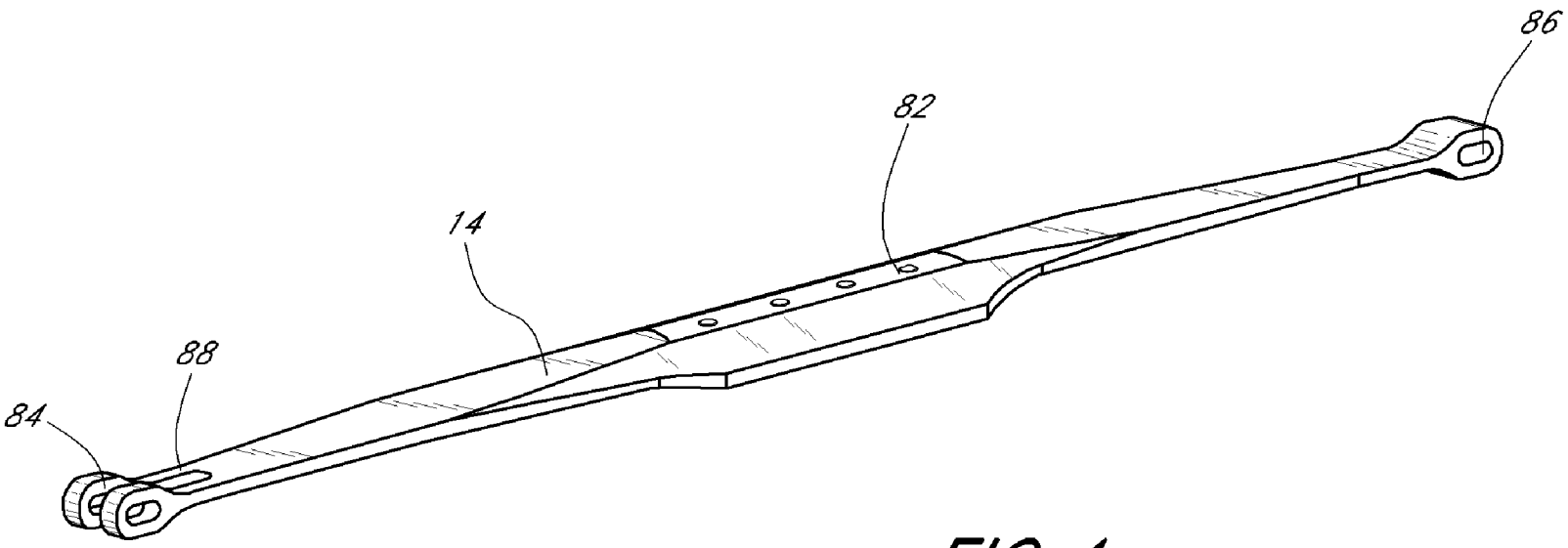
FIG. 4 is a perspective view of a continuous beam of the gripper assembly of FIG. 1.

With continued reference to FIG. 4, the rotatable connection of the toe link 56 to the support link 58 also includes an interface mechanism such as a roller 76 configured to roll in contact with the operating sleeve 52 during a portion of the expansion of the VLG gripper assembly. However, in the illustrated embodiment, the roller/link connection will only be in contact with the operating sleeve 52 during a portion of the expansion process, as further described below. Another rotatable connection such as a pinned connection can connect the support link 58 to a support block 80. In the illustrated embodiments, the support block 80 is rigidly connected to the mandrel 34.

With reference to FIG. 4, one embodiment of flexible continuous beam 14 is illustrated. In the illustrated embodiment, the flexible continuous beam is configured to be rotatably coupled to the expandable gripper assembly at its ends and configured to be expanded from between its ends by a radial expansion force applied by the linkage 12. It is contemplated that in other embodiments, the continuous beam 14 can have different configurations. The continuous beam can comprise one or a plurality of gripping elements 82. As illustrated, the continuous beam assembly has slots 84, 86 at each end thereof configured to be rotatably coupled to the continuous beam support 40 and mandrel cap 60. In some embodiments, the slots 84, 86 are elongate to allow for axial shortening of the continuous beam due to flexing of the beam during expansion of the VLG gripper assembly. In some embodiments, gripping elements 82, which can include inserts of textured or roughened material, are pressed into the outside of the continuous beam 14 to provide enhanced friction between the beam 14 and casing to effectively transfer load.

With continued reference to FIG. 4, in some embodiments the beam 14 can be bifurcated at one or both of its ends. In the illustrated embodiment, the end of the beam with slot 84 is bifurcated and includes a gap 88 formed between two adjacent substantially parallel slot members In the illustrated embodiment, the gap 88 extends substantially longitudinally with respect to the beam 14. In some embodiments, one end of the beam can include two slots and thus be trifurcated. When a rotatable connection such as a pinned connection couples the slots 84, 86 to the expandable gripper assembly 10 (FIG. 1), in some embodiments two relatively short pins can be used to couple a slot 84 at a bifurcated end of the beam 14 to the gripper assembly 10. A relatively short pin can have increased resistance to bending relative to a longer pin of similar diameter, thus allowing greater loads to be supported by a bifurcated end. When a beam 14 is used a downhole deployment on a tractor the slot 84, 86 at one end of the beam 14 will bear loads predominantly in tension and the slot 84, 86 at the opposite end will bear loads in compression. It can be desirable for the slot 84, 86 bearing loads in tension to be bifurcated such that its to withstand higher loads. A bifurcated beam end can have various advantages, including a relatively high fatigue life. For example, in some embodiments, a bifurcated beam end can have a fatigue life of greater than approximately 200,000 operation cycles.

While expandable gripper assemblies illustrated herein incorporate a continuous beam 14 to transfer force from the linkage 12 to a surface such as an inner wall of a well bore passage, it is contemplated that other structures could be used in other embodiments of gripper assembly to transfer force from the link assembly to the surface. For example, instead of a flexible continuous beam 14 as described herein, a multilink linkage gripper assembly including two or more pivotally coupled links could be disposed over the linkage assembly described herein. As with the continuous beam 14 described above, the linkage gripper assembly would be radially expanded by a radial expansion force applied between a first and second end of the linkage gripper assembly from the linkage 12. While the continuous beam 14, with its substantially featureless outer surface, is desirably less prone to becoming stuck on well bore irregularities, a linkage gripper assembly can potentially include link components shared with the linkage 12 and thus have relatively low manufacturing and maintenance costs.

In still other embodiments, it may be possible to eliminate the continuous beam 14 from the VLG. Rather, in these beamless embodiments, the linkage assembly could include a gripping surface disposed thereon, such as on an outer surface of the toe link 56. The gripping surface can include a plurality of gripping elements disposed on outer surfaces of one or more of the links. Furthermore, the links 54, 56, 58 comprising the linkage 12 could be shaped, such as for example with a curved outer surface, to provide a relatively large surface area of contact with a surface such as a wall of a passage.

B. Operation Description VLG

With reference to FIGS. 1-3, in the illustrated embodiments, the VLG is biased into a collapsed state. When pressure is not present in the actuator 20, the return spring 26 can exert a tensile force on the link members 54, 56, 58. This tensile force can keep the links 54, 56, 58 in a flat position substantially parallel to the elongate body of the VLG gripper, enabling the continuous beam 14 to collapse to a minimum diameter. In some embodiments, the continuous beam 14 can be a flexible "leaf spring" like member configured to produce a compressive force biasing it in a collapsed state when the links are in a flat position.

With reference to FIGS. 1 and 5-12, an expansion sequence of the VLG gripper from a fully collapsed or retracted position to a fully expanded position is illustrated sequentially. FIG. 1 illustrates an embodiment of VLG in a collapsed state. As discussed above, in the illustrated collapsed position, the linkage 12 is biased into a flat position substantially parallel to the elongate body of the VLG gripper, and the continuous beam 14 is collapsed.

Figure 5:
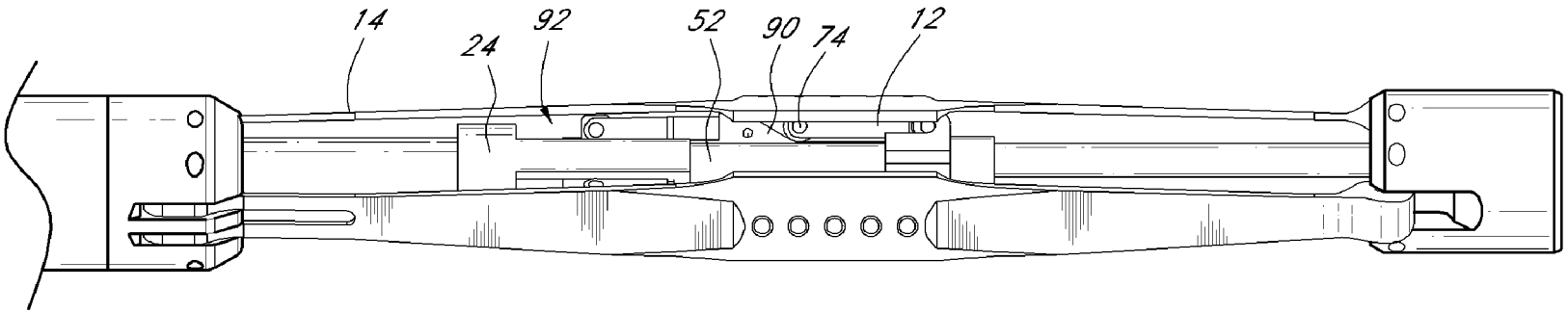
FIG. 5 is a side view of the linkage of the gripper assembly of FIG. 1 in a collapsed state.

FIG. 5 illustrates a partial cut-away view of VLG gripper in the collapsed position shown in FIG. 1 and further illustrates the relative positions of certain components of the illustrated embodiment of expandable gripper assembly. In the illustrated embodiment, the piston rod 24 is coupled to the operating sleeve 52. In other embodiments, the piston rod 24 can be unitarily formed with the operating sleeve 52. As illustrated, the linkage 12 and continuous beam 14 are each in substantially collapsed states. As illustrated, the piston rod 24 is fully retracted and the base of an expansion surface or ramp 90 on the operating sleeve 52 is adjacent the roller 74 at the connection of the push link 54 to the toe link 56. In the illustrated collapsed state, there is a gap 92 between the piston rod 24 and the push link support 64 at such that the linkage 12 is in a substantially flat orientation. The flattened links enable the continuous beam 14 to lay flat as well.

Figure 6:
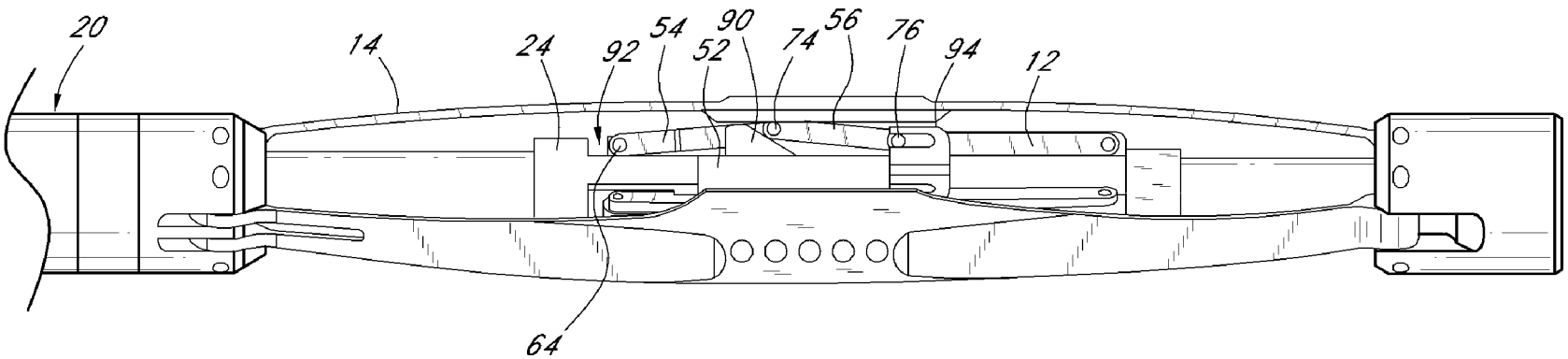
FIG. 6 is a side view of the linkage of the gripper assembly of FIG. 1 in a first stage of expansion.

With reference to FIG. 6, in some embodiments, the expansion surface comprises an inclined ramp having a substantially constant slope. In other embodiments, the expansion surface can comprise a curved ramp having a slope that varies along its length.

An embodiment of VLG in a first stage of expansion is illustrated in FIG. 6. As shown in FIG. 6, as the actuator 20 axially translates the piston rod 24 and operating sleeve 52, the ramp 90 of the operating sleeve 52 is advanced under the roller 74 positioned at the connection of the push link 54 to the toe link 56. As illustrated, the roller 74 bears on an inner surface of the continuous beam 14, expanding it radially outward. When the VLG gripper is expanded in a wellbore formation or casing, the continuous beam 14 can apply the radial expansion force to the formation or casing wall.

As illustrated in FIG. 6, the operating sleeve 52 further comprises a retention member 94 such as an elongate groove or slot formed in the operating sleeve such as by machine operation. The retention member 94 can constrain the connection between the toe link 56 and the support link 58 in a radially outward direction relative to the body of the VLG during initial expansion. Thus, the support link 58 can be retained in a position that is substantially parallel to the body of the VLG during the illustrated initial stage of expansion. In some embodiments, the retention member 94 can be configured to interface with the roller 76 positioned at the connection of the toe link 56 and the support link 58 to retain the support link 56. This retention of the support link 56 can allow the production of a normal load downwards into the operating sleeve at the connection of the toe link 56 to the support link 58 as the roller 74 is thrust upwards along the ramp 90 of the operating sleeve 52. This retention member 92 reduces the likelihood of an initial buckling of the support link 58.

As this axial translation of the piston rod 24 and operating sleeve 52 combination progresses, the gap 92 between the piston rod 24 and the push link support 64 is reduced. The expandable gripper assembly 10 can thus be configured such that during this initial phase of the expansion sequence, the push link 54 is not loaded in compression, but is free to move axially with respect to the body of the VLG to allow radial expansion of the linkage 12. The toe link 56 and support link 58 can be compressively loaded and constrained to develop downward normal forces for the roller 74 linked connection at their union. Thus, during this initial phase of expansion, substantially all of the radial expansion forces generated by the VLG are borne by the roller 74 rolling on the ramp 90 of the operating sleeve 52.

Figure 7:
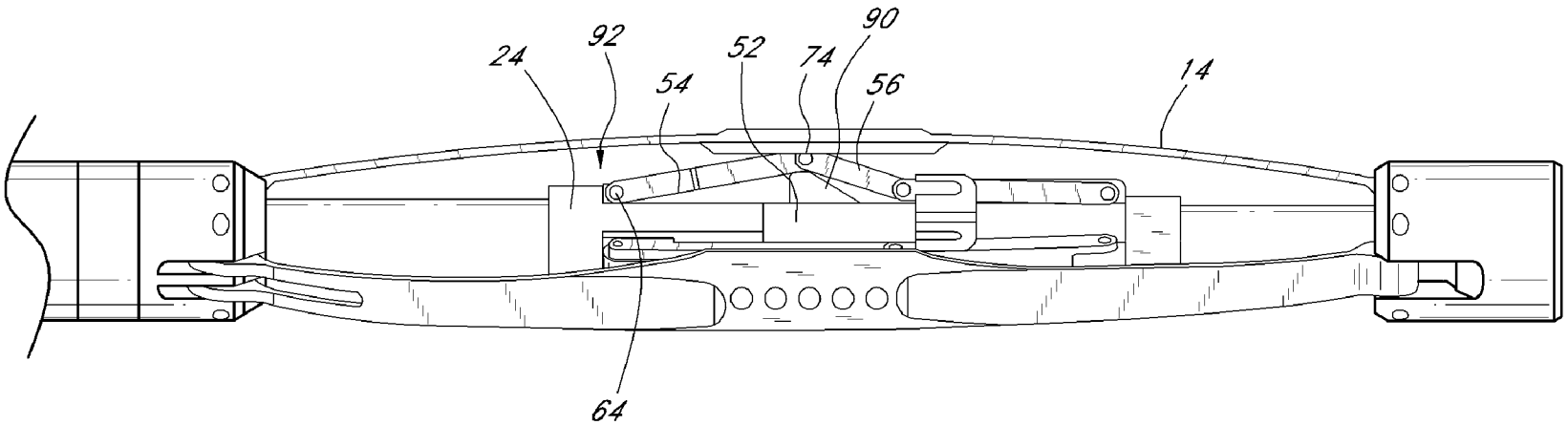
FIG. 7 is a side view of the linkage of the gripper assembly of FIG. 1 in a second stage of expansion.

In the illustrated embodiments, the initial phase of expansion described above with respect to FIG. 6 can continue until the actuator 20 advances the piston rod 24 such that the roller 74 reaches an expanded end of the ramp 90. FIG. 7 illustrates the expandable gripper assembly 10 of the VLG expanded to a point where the roller 74 has reached an expanded end of the ramp 90, and a second stage of expansion is set to begin. Once the roller 74 has reached the expanded end of the ramp 90, the actuator 20 can exert force on the push link 54 member of the mechanism. As illustrated, the piston rod 24 and operating sleeve 52 have continued to axially translate. In the illustrated embodiment, the linkage 12 is configured such that as the roller 74 approaches the top of the ramp 90, the gap 92 between the piston rod 24 and the push link support 64 has been reduced such that the piston rod 24 contacts the push link support 64. Thus, in the second stage of expansion, the actuator 20 begins to exert force via the piston rod 24 upon the push link 54. Continued application of force by the actuator 20 further radially expands and buckles the links 54, 56 with respect to the VLG body. In the illustrated embodiment, this continued expansion of the linkage 12 radially expands the continuous beam 14 such that the VLG gripper can apply a radial expansion force to a formation or casing wall.

Figure 8:
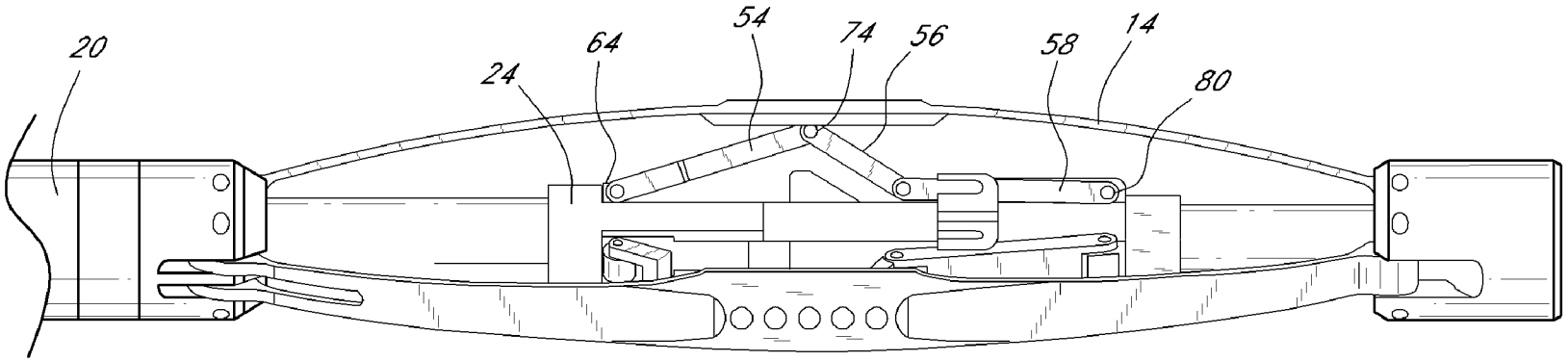
FIG. 8 is a side view of the linkage of the gripper assembly of FIG. 1 in a third stage of expansion.

With reference to FIG. 8, further expansion of the expandable assembly is illustrated. As illustrated, the piston rod 24 and operating sleeve 52 translation continues towards the support link block 80. In this stage of expansion, the continued buckling of the push link 54 and toe link 56 away from the VLG body has separated the roller 74 radially outward from the ramp 90 of the operating sleeve 52. Thus, in the illustrated expansion stage, the expansion of a three bar linkage defined by the push link 54, toe link 56, and the VLG body by the advancing piston rod 24 is the predominant generator of a radial expansion force. In the illustrated embodiments, this three bar linkage is the expansion mechanism which reacts forces through the continuous beam 14. The radial expansion force generated during this stage of the expansion is a function of the tangents of angle, $\alpha$, formed between the push link 54 and the VLG body and the angle, $\gamma$, formed between the toe link 56 and the axis of the VLG body and the piston force through the piston rod 24. Accordingly, as these angles increase, approaching ninety degrees, with continued expansion of the expandable gripper assembly, the expansion force generated increases. During high base angles of a three bar linkage, the tangent calculations of angles nearing 90 degrees approach infinity. These tangent calculations are multiplied by the piston rod force to get the expansion force. With a given piston rod force, the high tangent values can produce excessively high expansion forces.

The configuration of the linkage 12, and the geometry of the expansion surface of the operating sleeve 52, particularly the relative lengths of the links 54, 56, 58, and the position and height of the ramp 90 can determine the expansion ranges for which the primary mode of expansion force transfer is through the ramp 90 to roller 74 interface and the expansion range for which the primary expansion force is generated by the buckling of the links 56, 58 by the piston rod 24.

In some embodiments, where the VLG can be used for wellbore intervention in boreholes having relatively small entry points and potentially large washout sections, it can be desirable that a collapsed diameter of the VLG gripper is approximately 3 inches and an expanded diameter is approximately 8 inches, thus providing a total diametric expansion, defined as a difference between the expanded diameter and the collapsed diameter, of approximately 5 inches. It can be desirable that in certain embodiments, the ramp has a height at the expanded end thereof relative to the VLG body from between approximately 0.3 inches to approximately 1 inch, and desirably from 0.4 inches to 0.6 inches, such that for a diameter of the VLG gripper from approximately 3.7 inches to up to approximately 5.7 inches, and desirably, in some embodiments, up to approximately 4.7 inches, the primary mode of expansion force transfer is through the roller 74 to ramp 90 interface. At expanded diameters greater than approximately 5.7 inches, or, in some embodiments desirably approximately 4.7 inches, the primary mode of expansion force transfer is by continued buckling of the linkage 12 from axial force applied to one end of the push link 54 by the piston rod 24.

In some embodiments, the ratio of a length of the push link 54 to a length of the toe link 56 is from approximately 1.5:1 to 3:1. More desirably, the ratio is from approximately 1.8:1 to 2.3:1. In some embodiments, the push link 54 and the toe link 56 can be substantially equal in length.

As noted above, as the angles of expansion of the push link 54 and the toe link 56 increase, the expansion force, and thus the force of the links themselves and the link connectors increase. In some instances, the reaction force generated in linkage 12 can approach an amount that can damage the links 54, 56, 58 or connectors therebetween. In a three-bar linkage, further expansion by continued buckling of the links can damage the linkage as reaction forces exceed the material limits. Therefore, it can be desirable that an expandable assembly be configured such that expansion force is limited at relatively high expansion diameters. As described further with respect to FIGS. 9-12, in the VLG gripper, as the three-bar linkage formed in the expansion range described with respect to FIGS. 7 and 8 reaches an expansion diameter where relatively large expansion forces are generated, further expansion can be provided without further increasing the radial expansion forces generated by advancing an end of the toe link previously in contact with the VLG body radially outward from the VLG body.

Figure 9:
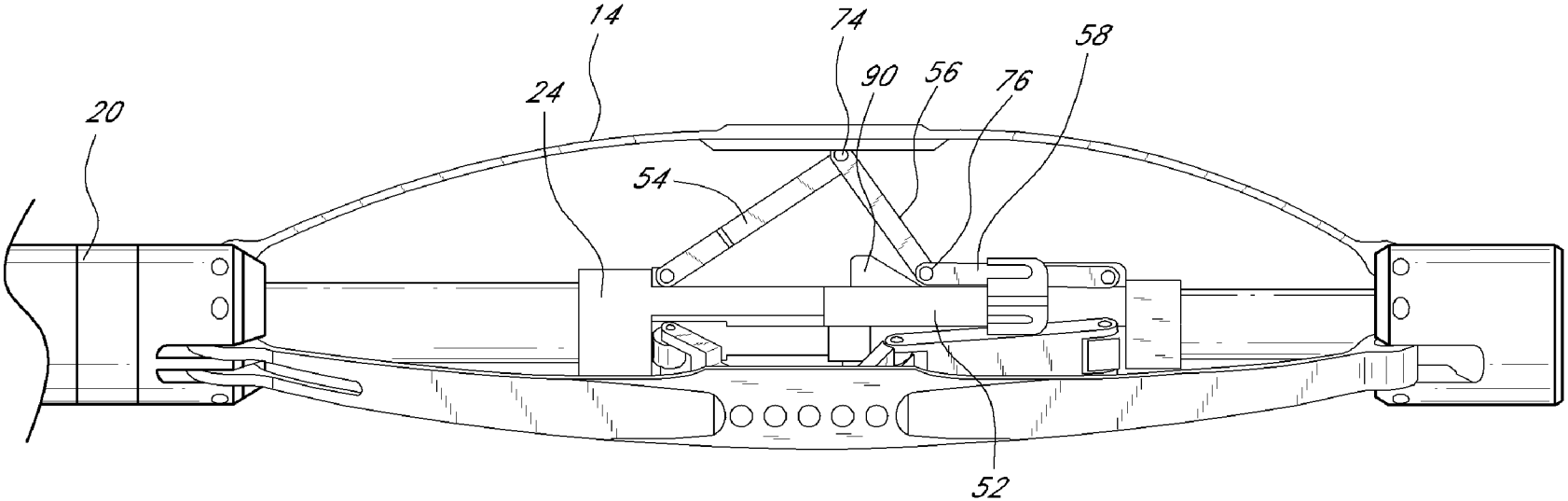
FIG. 9 is a side view of the linkage of the gripper assembly of FIG. 1 in a fourth stage of expansion.

FIGS. 9-12 illustrate one embodiment of VLG gripper in a further expansion sequence where an end of the toe link is advanced radially outward from the VLG body. With reference to FIG. 9, continued axial translation of the piston rod 24 advanced the expansion surface or ramp 90 of the operating sleeve 52 to the connection between the toe link 56 and the support link 58. As noted above, in some embodiments, a roller 76 can be positioned at the connection between the toe link 56 and the support link 58. The roller/link connection at 74 continues to follow the path dictated by the push link 54 and the toe link 56. In the illustrated fourth stage of expansion, to limit expansion force while providing a relatively large expansion output, the gripper assembly 10 is configured such that for relatively large expansion diameters the ramp 90 can impart a force on the link connection between the toe link 56 and the support link 58. As the ramp 90 is thrust underneath that roller link connection in the illustrated fourth stage, the linkage 12 forms a four-bar linkage a four-bar linkage defined by the push link 54, the toe link 56, the support link 58, and the VLG body. Thus, in some embodiments, the expandable gripper assembly is configured such that for one expansion range, the linkage 12 operates as a three bar linkage and for another expansion range, the linkage operates as a four-bar linkage.

Figure 10:
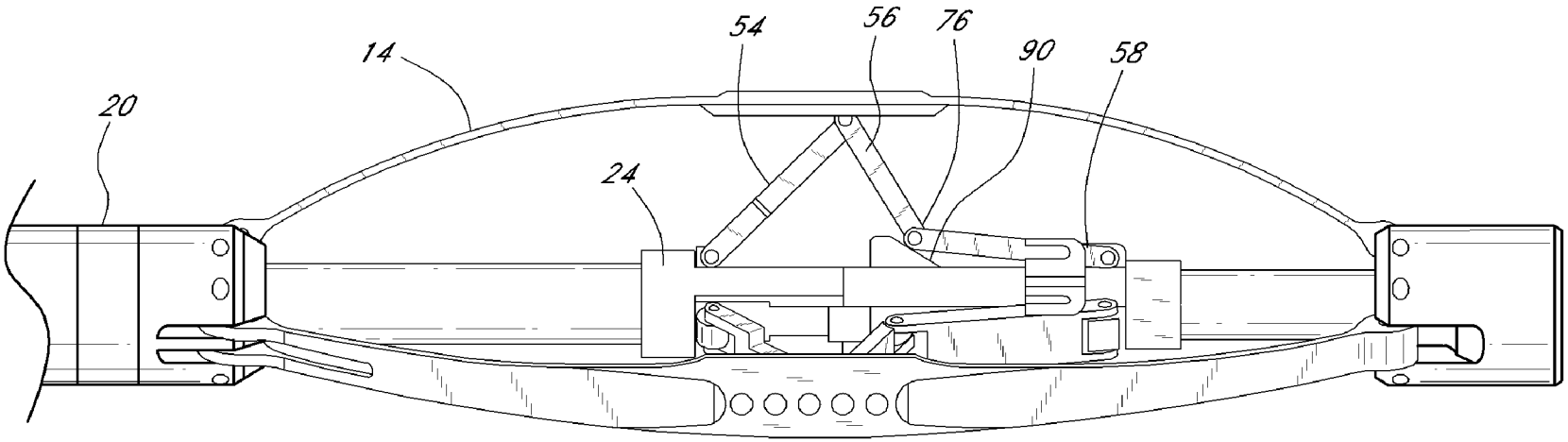
FIG. 10 is a side view of the linkage of the gripper assembly of FIG. 1 in a fifth stage of expansion.

With reference to FIG. 10, further expansion of the VLG gripper is illustrated. As illustrated, the axial translation of the piston rod 24 and operating sleeve 52 continues, driving the ramp 90 of the operating sleeve underneath the roller 76 at the connection of the toe link 56 and the support link 58. As the roller 76 progresses up the ramp 90, an effective four bar linkage is created as noted above. Continued advancement of the piston rod 24 by the actuator 20 advances the roller 76 up the ramp 90 of the operating sleeve 52. The ramp 90 can perform two functions. First, it can slow the rate of angle increase of the links 54, 56, 58 compared to piston stroke of the actuator 20 (limiting the tangent values and thus expansion forces), and second, it can increase radial expansion which decreases the force output of the mechanism by reducing the ratio of piston stroke to radial expansion.

In the illustrated embodiments of VLG gripper, the expandable gripper assembly 10 is configured such that a single ramp 90 on the operating sleeve 52 provides expansion at two expansion ranges. First, as described above with respect to FIGS. 5 and 6, the ramp 90 initially expands the expandable assembly at a first expansion range, allowing a relatively large expansion force to be generated at a relatively small expansion diameter of the gripper assembly. Second, as described with respect to FIGS. 9-12, the ramp 90 allows additional expansion of the linkage 12 at a relatively large expansion range. In the illustrated embodiment, the relative lengths of the links 54, 56, 58 and the piston stroke of the actuator 20 allow a single ramp to assist in expansion of the linkage 12 in both low and high expansion diameters. In some embodiments, multiple ramps 90 longitudinally separated on the operating sleeve 52, such as, for example, two ramps, can be used, with one ramp assisting to low expansion diameter operation of the linkage and a second ramp assisting with higher diameter expansion of the linkage.

Figure 11:
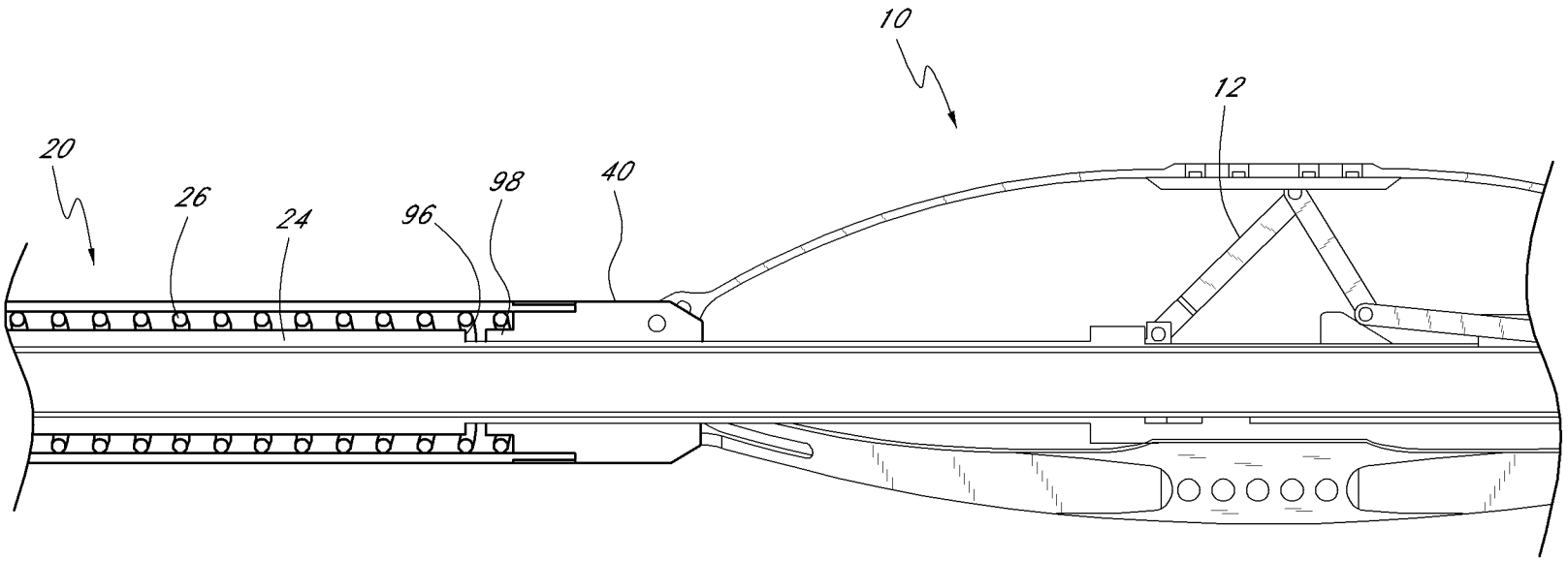
FIG. 11 is a cross-sectional side view of the actuator of the gripper assembly of FIG. 1 in the fifth stage of expansion.

With reference to FIG. 11, an embodiment of VLG gripper having a piston stroke limiting mechanism is illustrated. As shown, as the expandable gripper assembly approaches an expanded configuration, the piston rod 24 nears the end of the piston stroke. In some embodiments, an interference surface 96 on the piston rod 24 is configured to contact point an interference surface 98 of the continuous beam support 40. In this embodiment, when this contact is reached, no further axial translation of piston rod 24/operating sleeve 52 combination can occur. This stroke limiting configuration greatly reduces the possibility of overstressing the gripper and eliminates the possibility of thrusting the operating sleeve 52 far enough under the roller 76 connection to pass the expanded end of the ramp 90. In some embodiments, the actuator 20 can have a total stroke length of approximately 8 inches.

Figure 12:
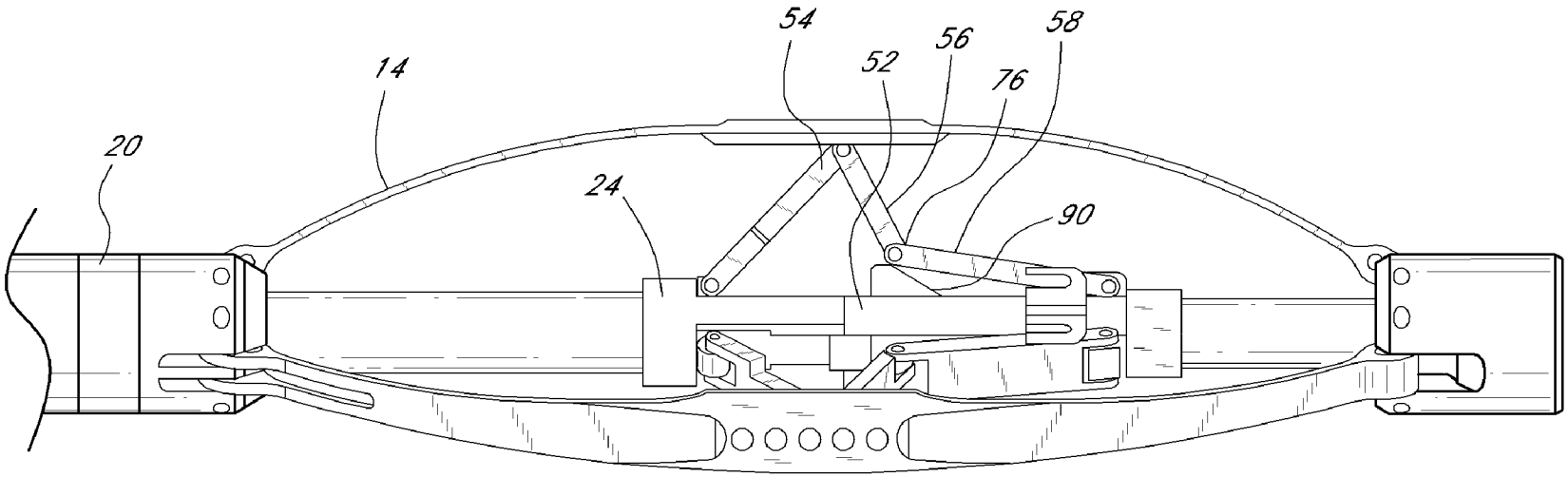
FIG. 12 is a side view of the linkage of the gripper assembly of FIG. 1 in a sixth stage of expansion.

FIG. 12 illustrates a VLG gripper in an expanded configuration. As illustrated, the roller 76 at the connection of the toe link 56 and the support link 58 has been advanced to the expanded end of the ramp 90 of the operating sleeve 52. Accordingly, an end of the toe link 56 has been advanced radially outward from the VLG body by the ramp 90. As discussed above with respect to FIG. 11, in some embodiments, mating interference surfaces 96, 98 in the piston rod 24 and the continuous beam support 40 can prevent further advancement of the piston rod 24 beyond this expanded configuration. All of the parts of the mechanism can be designed with materials and geometric features selected to withstand the maximum stresses encountered by the expandable gripper assembly in an expansion sequence between the collapsed state and this final expanded state.

Figure 13:
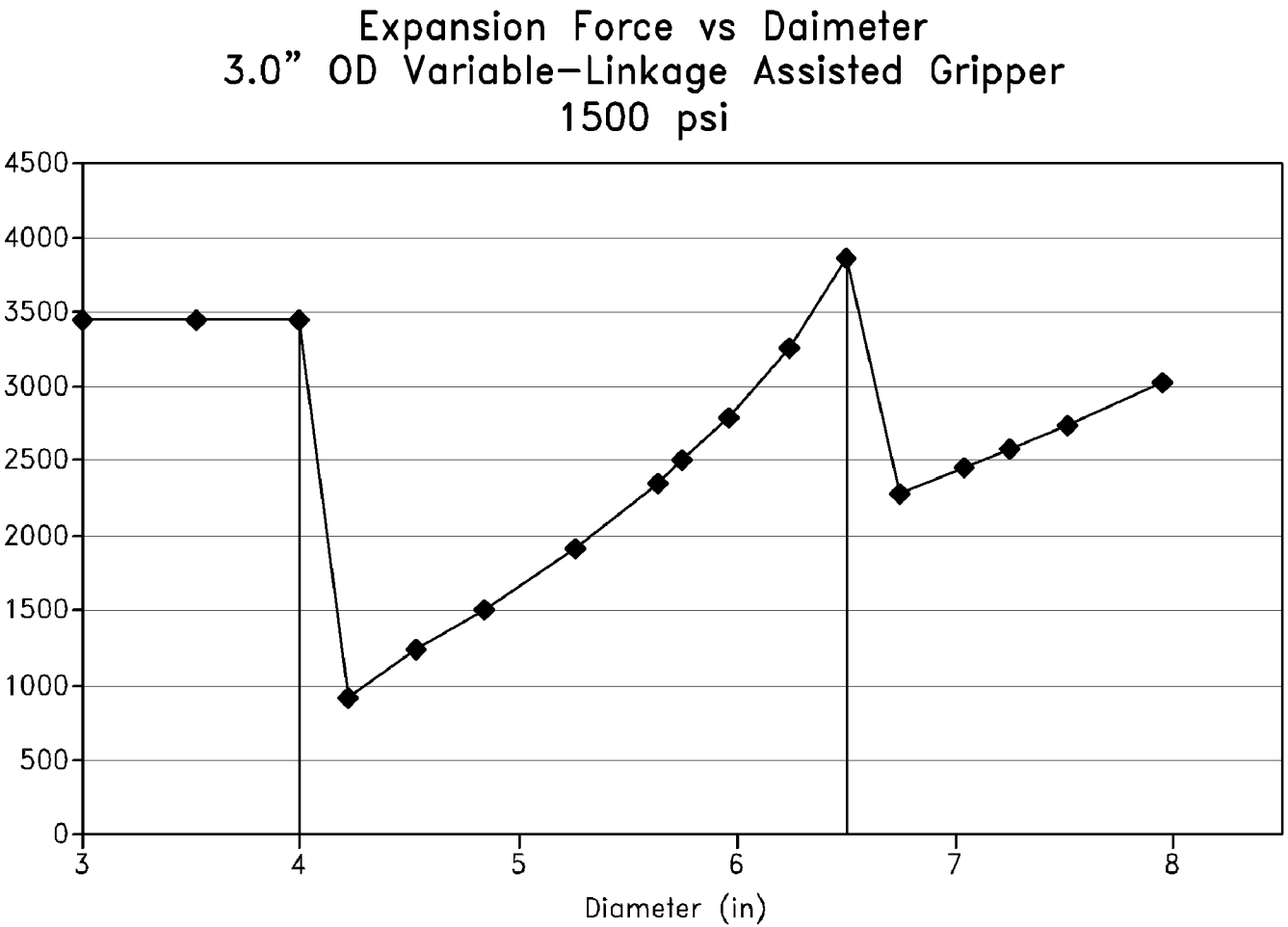
FIG. 13 is a line graph illustrating the expansion force exerted versus expansion diameter for one embodiment of gripper assembly.

FIG. 13 illustrates an expansion force versus expansion diameter for an exemplary VLG embodiment. While certain values for expansion ranges and expansion forces are plotted on the graph of FIG. 13 and these values can provide significant benefits over other designs, unless otherwise stated, these values are not limiting and it is recognized that a VLG can be configured to operate in a wide range of expansion diameters to generate a wide range of expansion forces.

As illustrated by FIG. 13, in some embodiments, the gripper assembly can be configured such that the ratio of minimum expansion force generated by the gripper assembly during force transmission through the ramp 90 alone (such as, for example, as discussed with respect to FIGS. 5 and 6 above) to the minimum expansion force generated by the gripper assembly operating as a three bar linkage (such as, for example, as discussed with respect to FIGS. 7 and 8 above) can be less than 8:1 and is desirably less than approximately 5:1. This ratio is desirably less than approximately 4:1 and is preferably approximately 3.5:1. In some embodiments, the gripper assembly can be configured such that the ratio of maximum expansion force generated by the gripper assembly operating as a three bar linkage (such as, for example, as discussed above with respect to FIGS. 7 and 8) to the minimum expansion force generated as a four bar linkage plus force generated by transmission through the ramp 90 (such as, for example, as discussed above with respect to FIGS. 11-14) is desirably less than approximately 3:1 and is preferably approximately 2:1.

With continued reference to FIG. 13, in some embodiments, each gripper assembly of a VLG is configured such that the maximum expansion force generated is less than approximately 5,000 pounds and desirably less than approximately 4,000 pounds over the entire range of expansion of the gripper assembly. In some embodiments, as illustrated in FIG. 12, the VLG can include three gripper assemblies substantially evenly spaced circumferentially about the body. In other embodiments, the VLG can include more or fewer than three gripper assemblies such as for example one, two, or four gripper assemblies. In some embodiments, each gripper assembly is configured such that the minimum expansion force is greater than approximately 500 pounds and desirably greater than approximately 1,000 pounds over the entire range of expansion of the gripper. In some embodiments, each gripper assembly can be configured to expand to desirably greater than five inches diameter and preferably approximately eight inches in diameter. The combinations of expansion mechanisms of the VLG embodiments described herein can limit the force output, while still maintaining sufficient expansion force to grip a casing over a wide range of expansion diameters. Desirably, the limitation of force output can reduce the risk of overstressing the components of the VLG during the full range of expansion.

Advantageously, the VLG combines desirable attributes of a several different expansion mechanisms to provide for a wider range of acceptable expansion diameters. Roller/ramp interfaces provide expansion force at relatively low expansion diameters and the three or four-bar linkages provide high expansion diameters for less piston rod stroke than other designs. However, either mechanism alone has its limits. Roller/ramp interfaces require relatively long piston rod stroke and can only achieve certain expansion diameters due to collapsed diameter geometry constraints. Three and four-bar linkages produce insufficient expansion force at low link angles and excessive expansion forces at high expansion diameters. When the two mechanisms are combined in a VLG, desirably, acceptable expansion forces across a relatively large expansion range can be achieved. For example, in some embodiments, a ratio of stroke length to expansion diameter can be approximately 3.1/5. In various embodiments, a ratio of stroke length to expansion diameter can be 2/5, 1/2, 3/5, 7/10, 4/5 or 1/1, or, the ratio can be in a range of between approximately 2/5 and 1/1, in a range between approximately 2/5 and 4/5, in a range between approximately 1/2 and 1/1, in a range between approximately 1/2 and 4/5, or in a range between approximately 3/5 and 1/1.

C. VLG Gripper Assembly with Receiver Link

While the embodiments of VLG gripper assembly illustrated in FIGS. 1-12 include a movable expansion surface such as a ramp, with reference to FIGS. 14-18, in some embodiments, a linkage of the VLG can include a receiver link. FIGS. 14-18 schematically illustrate an expansion sequence of a linkage for a VLG gripper including a receiver link.

Figure 14:
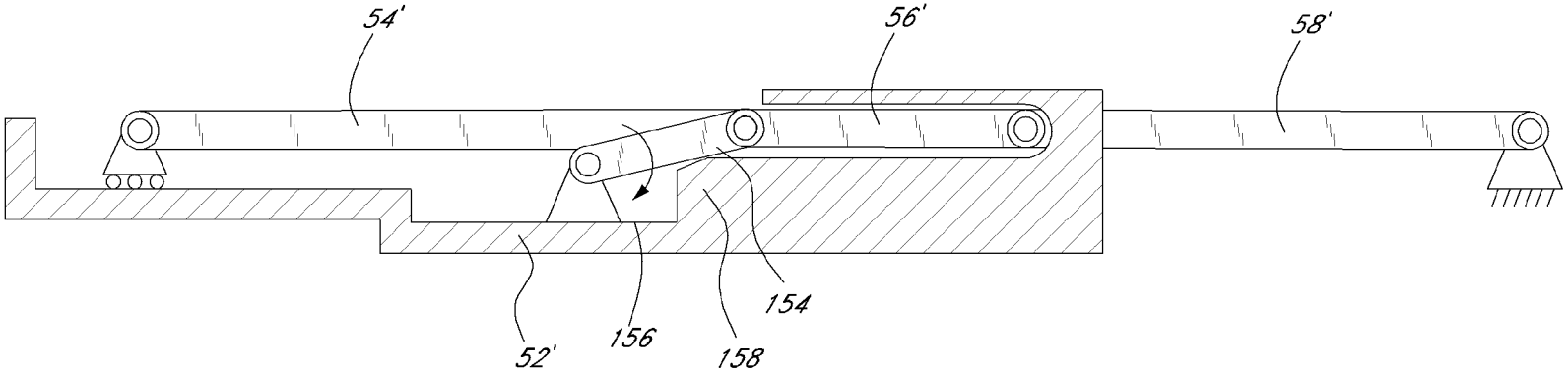
FIG. 14 is a schematic view of an embodiment of linkage configuration in a collapsed state.

With respect to FIG. 14, a linkage similar to that discussed in the VLG embodiment of FIG. 1 is schematically illustrated in a collapsed position. The linkage can comprise a push link 54', a toe link 56', and a support link 58'. The push link 54' is shown having a slidable connection to a piston rod 24', and the support link 58' has a rotatable connection. As illustrated, the linkage further comprises a receiver link 154 rotatably coupled to the operating sleeve 52' at one end. An opposite end of the receiver link 154 can be configured to couple to a connection of two links 54', 56', 58' of the linkage. When in the retracted position, the receiver link 154 is coupled to the connection of the push link 54' and the toe link 56'. The receiver link 154 can have a torsion spring configured to bias the receiver link 154 into a retracted position corresponding to the collapsed position of the linkage. The operating sleeve 52' can have a recess 156 in which the receiver link 154 is rotatably mounted, and can have a support 158 on which the receiver link 154 rests in the retracted position.

Figure 15:
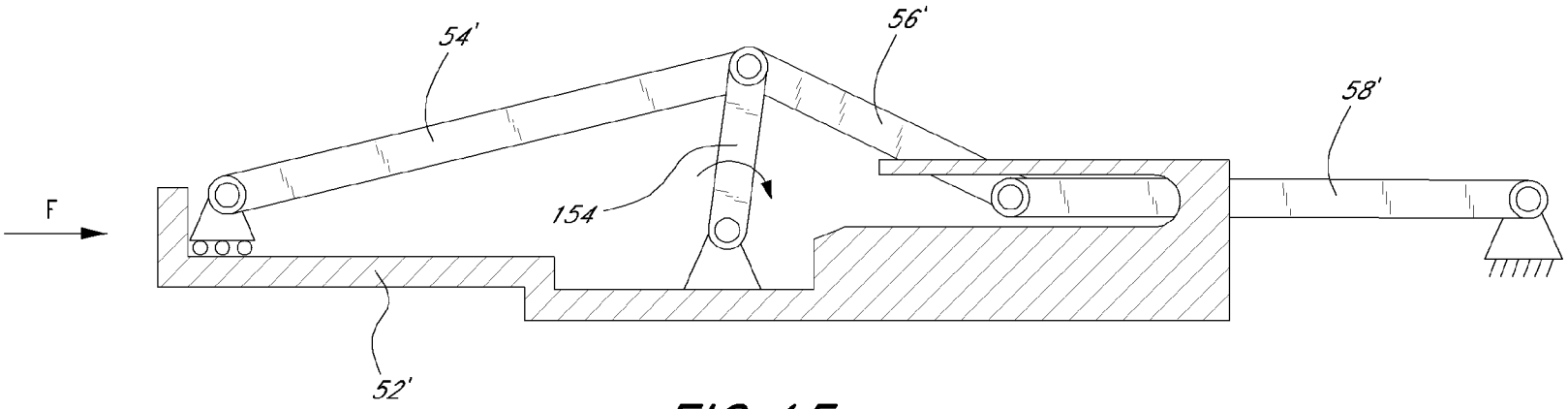
FIG. 15 is a schematic view of the linkage of FIG. 14 in a first stage of expansion.

With reference to FIG. 15, during a first expansion stage, the operating sleeve 52' translates as a longitudinal force is applied to the operating sleeve 52' such as by an actuator described above with respect to FIG. 2, or another suitable actuator. As the operating sleeve 52' translates, the receiver link begins to rotate, thus applying a radial expansion force to the connection of the push link 54' and the toe link 56'.

Figure 16:
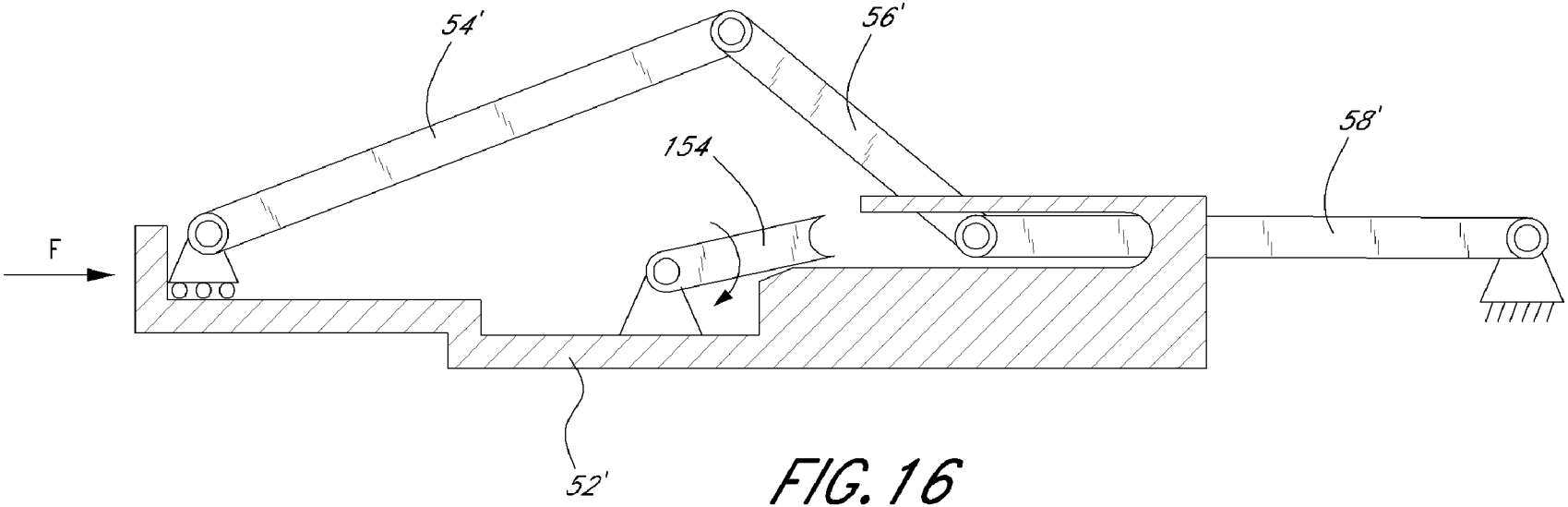
FIG. 16 is a schematic view of the linkage of FIG. 14 in a second stage of expansion.

With reference to FIG. 16, during a second expansion stage, the operating sleeve 52' continues to translate as the receiver link 154 is fully radially extended, and the operating sleeve 52' contacts the slidable mount of the push link 54'. The receiver link 154 can decouple from the connection of the push link 54' and the toe link 56'. Further radial expansion of the linkage can be provided during the second expansion stage by the operating sleeve 52' bearing against an end of the push link to slide the push link 54' relative to the longitudinally fixed end of the support link 58'.

Figure 17:
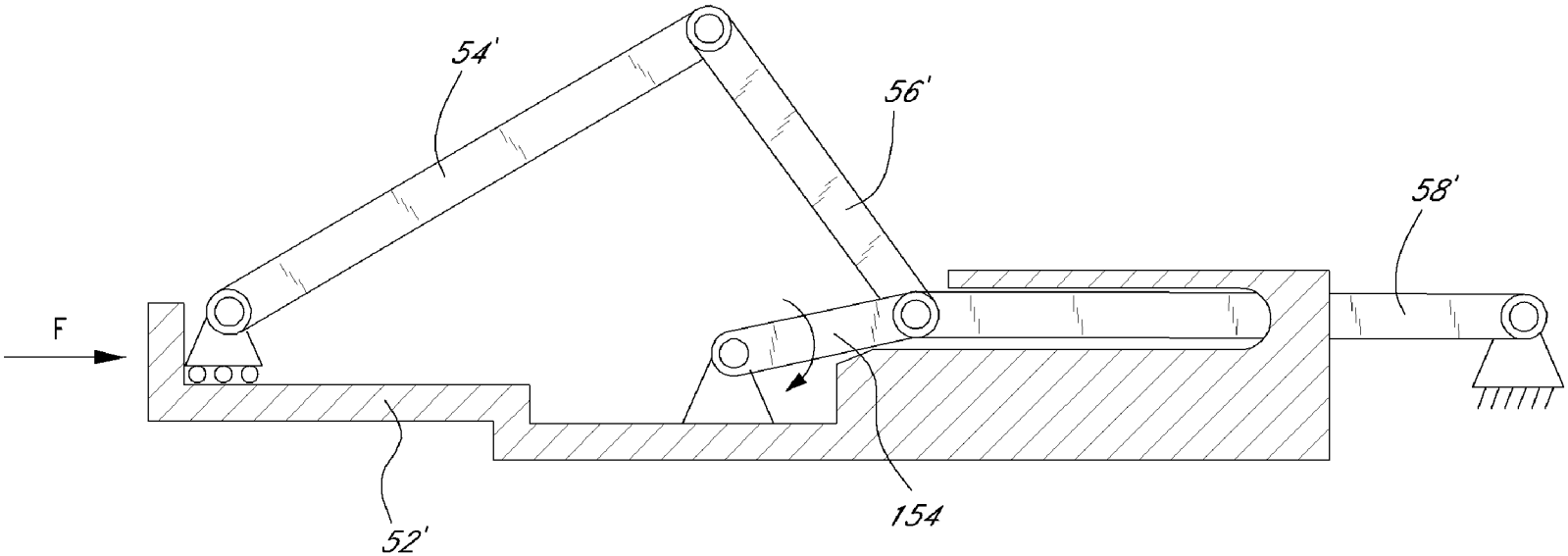
FIG. 17 is a schematic view of the linkage of FIG. 14 in a third stage of expansion.
Figure 18:
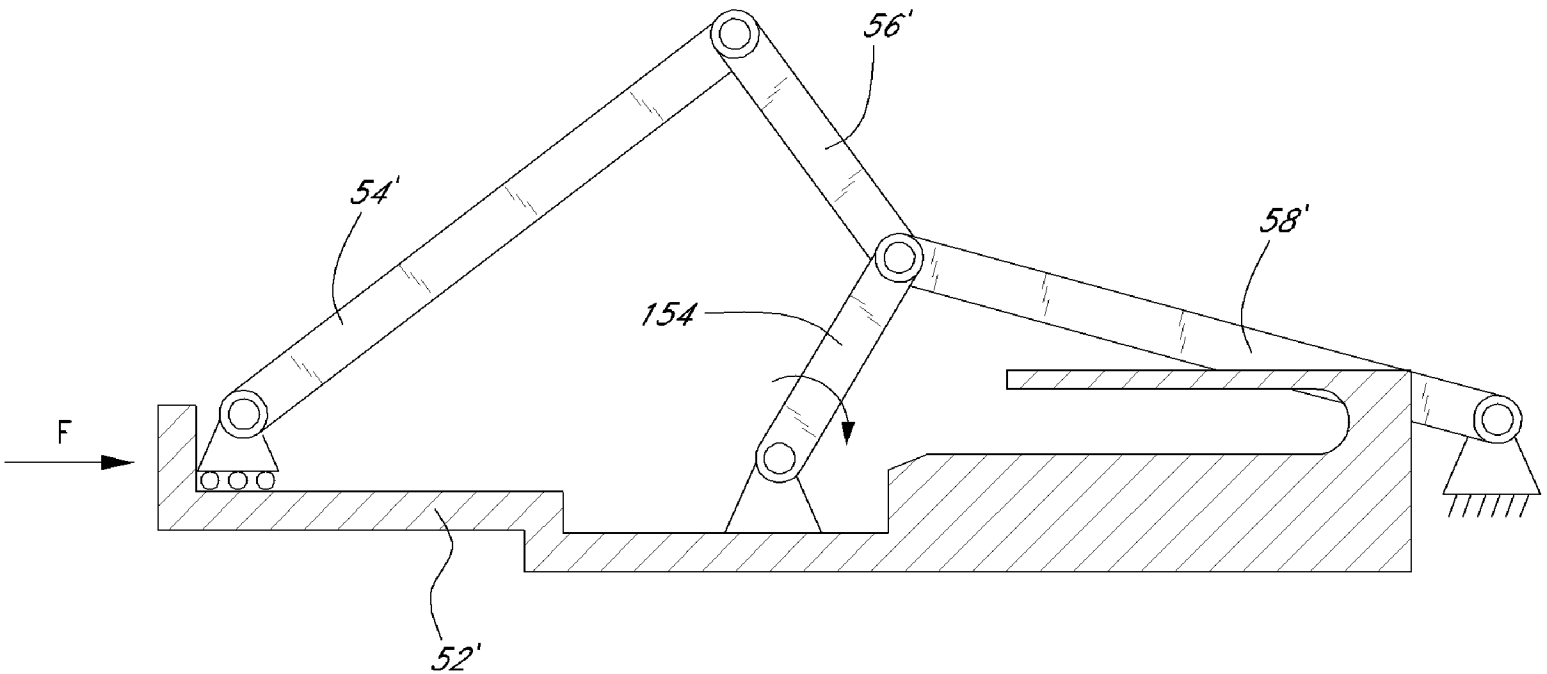
FIG. 18 is a schematic view of the linkage of FIG. 14 in a fourth stage of expansion.

With respect to FIG. 17, during a third expansion stage, continued translation of the operating sleeve has positioned an end of the receiver link 154 at the connection of the toe link 56' with the support link 58'. Upon continued translation of the operating sleeve 52' during the third expansion stage, the receiver link 154 advances the connection of the toe link 56' and the support link 58' radially outward. FIG. 18 illustrates a fourth expansion stage of the linkage in which the linkage has been further radially expanded by the receiver link 154 advancing the connection of the toe link 56' and the support link 58' radially outward.

Although these inventions have been disclosed in the context of a certain preferred embodiment and examples, it will be understood by those skilled in the art that the present inventions extend beyond the specifically disclosed embodiments to other alternative embodiments and/or uses of the invention and obvious modifications and equivalents thereof. Additionally, it is contemplated that various aspects and features of the inventions described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A gripper assembly comprising an elongate body having a length along a first axis;

a linkage configured to be radially expanded between a retracted position and an expanded position relative to the elongate body, the linkage comprising a first link having a first end and a second end, and a second link having a first end and a second end, and a third link having a first end and a second end, said second end of the first link coupled to the first end of the second link at a first pivot, the second end of the second link coupled to the first end of the third link at a second pivot; and a retention member configured to substantially prevent movement of the second pivot in a radially outward direction relative to the elongate body during an initial phase of expansion of the linkage from the retracted position toward the expanded position.

2. The gripper assembly of claim 1, wherein the first end of the first link slidable with respect to the elongate body.

3. The gripper assembly of claim 1, wherein the retention member comprises a groove.

4. The gripper assembly of claim 1, wherein the retention member comprises a slot.

5. The gripper assembly of claim 1, wherein the retention member forms a portion of an operating sleeve.

6. The gripper assembly of claim 1, wherein the retention member retains the third link in an orientation substantially parallel to the elongate body during the initial phase of expansion.

7. The gripper assembly of claim 1, further comprising a ramp coupled to the elongate body and positioned for engagement with the first pivot during at least a portion of the expansion of the linkage.

8. The gripper assembly of claim 7, wherein the ramp is positioned for engagement with the second pivot during at least a portion of the expansion of the linkage.

9. The gripper assembly of claim 8, further comprising a roller positioned at the second pivot, the roller being configured to interact with the ramp to urge the second pivot radially outwardly from the elongate body.

10. The gripper assembly of claim 1, wherein the third link is retained in a position that is substantially parallel to the elongate body during the initial phase of expansion.

11. A gripper assembly comprising:

an elongate body having a length along a first axis;

a linkage configured to be radially expanded between a retracted position and an expanded position relative to the elongate body, the linkage comprising a first link having a first end and a second end, and a second link having a first end and a second end, and a third link having a first end and a second end, said second end of the first link coupled to the first end of the second link at a first pivot, the second end of the second link coupled to the first end of the third link at a second pivot;

a retention member configured to constrain the second pivot in a radially outward direction relative to the elongate body during an initial phase of expansion of the linkage from the retracted position toward the expanded position; and a roller positioned at the second pivot, the roller being configured to interact with the retention member to constrain movement of the second pivot.

12. A gripper assembly comprising:

an elongate body having a length along a first axis;

a linkage configured to be radially expanded between a retracted position and an expanded position relative to the elongate body, the linkage comprising a first link having a first end and a second end, and a second link having a first end and a second end, and a third link having a first end and a second end, said second end of the first link coupled to the first end of the second link at a first pivot, the second end of the second link coupled to the first end of the third link at a second pivot;

a retention member configured to constrain the second pivot in a radially outward direction relative to the elongate body during an initial phase of expansion of the linkage from the retracted position toward the expanded position; and a fourth link.

13. The gripper assembly of claim 12, wherein the fourth link is configured to vault the first pivot radially outwardly from the elongate body.

14. The gripper assembly of claim 13, wherein the fourth link is configured to vault the second pivot radially outwardly from the elongate body.

15. A method for imparting a force to a passage, comprising:

positioning a force applicator in the passage, the force applicator comprising an expandable assembly comprising an elongate body and a linkage, the linkage comprising a first link having first and second ends, a second link having first and second ends, and a third link have first and second ends, the first end of the first link being coupled to the elongate body, the second end of the first link being coupled to the first end of the second link at a first pivot, the second end of the second link being coupled to a first end of the third link at a second pivot;

buckling the first pivot radially outwardly from the elongate body while constraining movement of the second pivot in a radially outward direction away from the elongate body; and moving the second pivot radially outwardly from the elongate body.

16. The method of claim 15, wherein the force applicator further comprises a flexible continuous beam coupled to the elongate body, further comprising radially expanding the beam relative to the elongate body under the influence of expansion of the linkage.

17. The method of claim 15, wherein said buckling comprises operatively engaging the first pivot with a ramp, the ramp being coupled to the elongate body.

18. The method of claim 17, wherein said linkage comprises a roller and said buckling comprises rolling the roller along the ramp.

19. The method of claim 15, where said buckling comprises operatively engaging the second pivot with a ramp, the ramp being coupled to the elongate body.

20. The method of claim 19, wherein said linkage comprises a roller and said buckling comprises rolling the roller along the ramp.

21. The method of claim 15, wherein said linkage comprises a roller and said constraining comprises rolling the roller along a retention member coupled with the elongate body.

22. The method of claim 15, wherein the force applicator further comprises a fourth linkage having a first end coupled to the elongate body and a second end coupled to the linkage, and said buckling comprises rotating the fourth link relative to the elongate body.

23. The method of claim 22, further comprising disengaging the second end of the fourth link from the first pivot and engaging the second end of the fourth link with the second pivot.

* * * * *

UNITED STATES PATENT AND TRADEMARK OFFICE

CERTIFICATE OF CORRECTION

PATENT NO. : 8,061,447 B2
APPLICATION NO. : 12/819126
DATED : November 22, 2011
INVENTOR(S) : Rudolph Ernst Krueger, V It is certified that error appears in the above-identified patent and that said Letters Patent is hereby corrected as shown below:

At Sheet 13 of 18 (FIG. 13), Line 1, Change “Daimeter” to --Diameter--.

At Column 2, Line 55, Change “link” to --link.--.

At Column 14, Line 48, In Claim 1, Change “comprising” to --comprising:--.

Signed and Sealed this
Eleventh Day of September, 2012

David J. Kappos

David J. Kappos
*Director of the United States Patent and Trademark Office*